US008388300B1

(12) United States Patent
Liang

(10) Patent No.: US 8,388,300 B1
(45) Date of Patent: Mar. 5, 2013

(54) TURBINE RING SEGMENT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 441 days.

(21) Appl. No.: 12/840,671

(22) Filed: Jul. 21, 2010

(51) Int. Cl.
*F01D 11/08* (2006.01)

(52) U.S. Cl. ..... 415/1; 415/115; 415/173.1

(58) Field of Classification Search ..... 415/173.1, 415/1, 170.1, 116, 115
See application file for complete search history.

(56) References Cited

U.S. PATENT DOCUMENTS 5,993,150 A * 11/1999 Liotta et al. ..... 415/115
6,508,623 B1 * 1/2003 Shiozaki et al. ..... 415/173.1
7,033,138 B2 * 4/2006 Tomita et al. ..... 415/139
2006/0140753 A1 * 6/2006 Romanov et al. ..... 415/173.1
2008/0118346 A1 * 5/2008 Liang ..... 415/115

* cited by examiner

*Primary Examiner* — Nathaniel Wiehe
*Assistant Examiner* — Aaron Jagoda
(74) *Attorney, Agent, or Firm* — John Ryznic

(57) ABSTRACT

A ring segment for a turbine in a gas turbine engine, the ring segment having a backside impingement cavity to collect spent impingement cooling air, and a number of separate impingement chambers spaced around all four edges of the ring segment to provide impingement cooling for the edges. Each impingement chamber is connected to the central impingement cavity by a number of metering and impingement holes to supply cooling air and a number of cooling air exit holes to discharge the cooling air out the sides of the four edges. The trailing edge of the ring segment includes two rows of impingement chambers connected in series.

6 Claims, 3 Drawing Sheets

TURBINE RING SEGMENT

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine ring segment with a cooling circuit.

2. Description of the Related Art Including Information Disclosed Under 37 CFR 1.97 and 1.98

A gas turbine engine, such as a large frame heavy duty industrial gas turbine (IGT) engine, includes a turbine with one or more rows of stator vanes and rotor blades that react with a hot gas stream from a combustor to produce mechanical work. The stator vanes guide the hot gas stream into the adjacent and downstream row of rotor blades. The first stage vanes and blades are exposed to the highest gas stream temperatures and therefore require the most amount of cooling.

The efficiency of the engine can be increased by using a higher turbine inlet temperature. However, increasing the temperature requires better cooling of the airfoils or improved materials that can withstand these higher temperatures. Turbine airfoils (vanes and blades) are cooled using a combination of convection and impingement cooling within the airfoils and film cooling on the external airfoil surfaces.

A blade outer air seal (BOAS) is formed around the turbine rotor blades 16 to create a seal against hot gas flow leakage. The BOAS is formed from a number or ring segments that together form a full annular ring around the stage of rotor blades. FIG. 1 shows a prior art ring segment with a blade ring carrier 11, a cooling air supply hole 12 formed in the ring carrier 11, two isolation rings 13 that are also formed as segments, a ring segment 15 supported by the two isolation rings 13, and an impingement plate 18 secured to the ring segment. An upstream vane 14 (left side) and a downstream vane 14 (right side) is located on both sides of the rotor blade 16 and two isolation rings 13. The impingement plate 18 includes a number of metering and impingement holes to discharge cooling air from a cooling air supply cavity 17 formed between the isolation rings 13 and the blade ring carrier 11 to a backside surface of the ring segment 15 for impingement cooling. The spent impingement cooling air is collected in an impingement pocket 19 to be discharged through cooling holes formed in the ring segment 15.

FIG. 2 shows a detailed view of a prior art ring segment with a cooling circuit. An impingement plate 18 is secured over the ring segment 15 to form an impingement cavity between the two pieces. The ring segment 15 includes cooling air holes 8 that connect to the impingement cavity 19 and discharge the spent impingement air from the cavity 19 and onto the sides of the ring segment 15 for cooling and sealing purposes. FIG. 3 shows a top view of the ring segment 15 with a number of hooks 20 that are used to secure the ring segment 15 to the isolation rings 13. The impingement cavity 19 is located between the four sides with two mate faces on the left side and the right side, and the L/E on the top and the T/E on the bottom. FIG. 4 shows a detailed view from the top of the ring segment with the cooling holes 8 connected to the cavity 19 and opening onto the four sides of the ring segment 15 to provide cooling and sealing all around the four sides.

The prior art ring segments are cooled using backside impingement cooling in the middle of the ring segment, and then using the spent impingement cooling air to cooling around the peripheral of the ring segment with the discharged cooling air then used for sealing around the sides or as purge air for adjacent cavities to prevent ingestion of the hot gas flow passing through the turbine. The discharge cooling air holes are drilled around the ring segment impingement cavity from both of the two mate faces as well as on the L/E and T/E sides. In general, the overall cooling for this circuit is very low, especially around the peripheral sides.

One issue with the prior art ring segment cooling designs is the impingement cavity supplies all of the cooling air for the peripheral cooling holes while the ring segment is subject to several circumferential and axial external gas side pressure variations. In addition, the impingement cavity pressure has to be high enough in order to satisfy any back flow margin (prevent external hot gas from flowing through the cooling holes and into the inside of the ring segment) for the ring segment leading edge. This requires a higher cooling supply pressure to prevent back flow which then leads to higher leakage flow around the ring segment. The high post impingement also induces a high pressure ratio across the ring segment trailing edge. Fewer convection cooling holes can be used at the trailing edge section for the cooling and yields a wider spacing between adjacent cooling holes.

The ring segments in an IGT engine are especially prone to early erosion due to the high gas flow temperatures that react around the segments. Ring segments typically use a TBC to provide additional protection from the high temperature gas flow. Because of transients from stopping and starting the engine, the ring segments pass through large temperature differences from the hot steady state to the cold ambient state when the engine is not running. These large temperature differences create large thermal gradients in the ring segments—as well as other parts of the turbine—that cause spalling of the TBC. Therefore, improved cooling of the ring segments is required so that part life, and therefore engine life, can be increased. Long part life is more important in an IGT engine because these engines typically operate continuously for very long periods of time, such as over 40,000 hours. Damaged parts will decrease the efficiency of the engine.

BRIEF SUMMARY OF THE INVENTION

A ring segment for a turbine in a gas turbine engine with a cooling circuit that provides for multiple impingement cooling in combination with a modular impingement and metering cooling air flow circuit for the ring segment peripheral edges. The use of multiple pressure regulators in the cooling circuit in the edges with mid-section backside impingement cooling will allow for the distribution of the cooling air to be fully controlled. The multiple pressure regulators are formed by casting the pressure intermediate chambers within the ring segment peripheral edges to form an edge cooling circuit. The pressure regulator modular cooling flow circuit can be constructed in many forms and numbers depending on the external pressure gradient and pressure ratio across the edges.

DETAILED DESCRIPTION OF THE INVENTION

The present invention is a ring segment for a turbine in a gas turbine engine, especially for a large frame heavy duty industrial gas turbine (IGT) engine that requires a long service life. Ring segments are used to form a seal with the turbine rotor blades and are commonly referred to a Blade outer Air Seals, or BOAS. Each ring segment includes forward hooks and aft hooks that secure the ring segment to forward and aft isolation rings.

Figure 1:
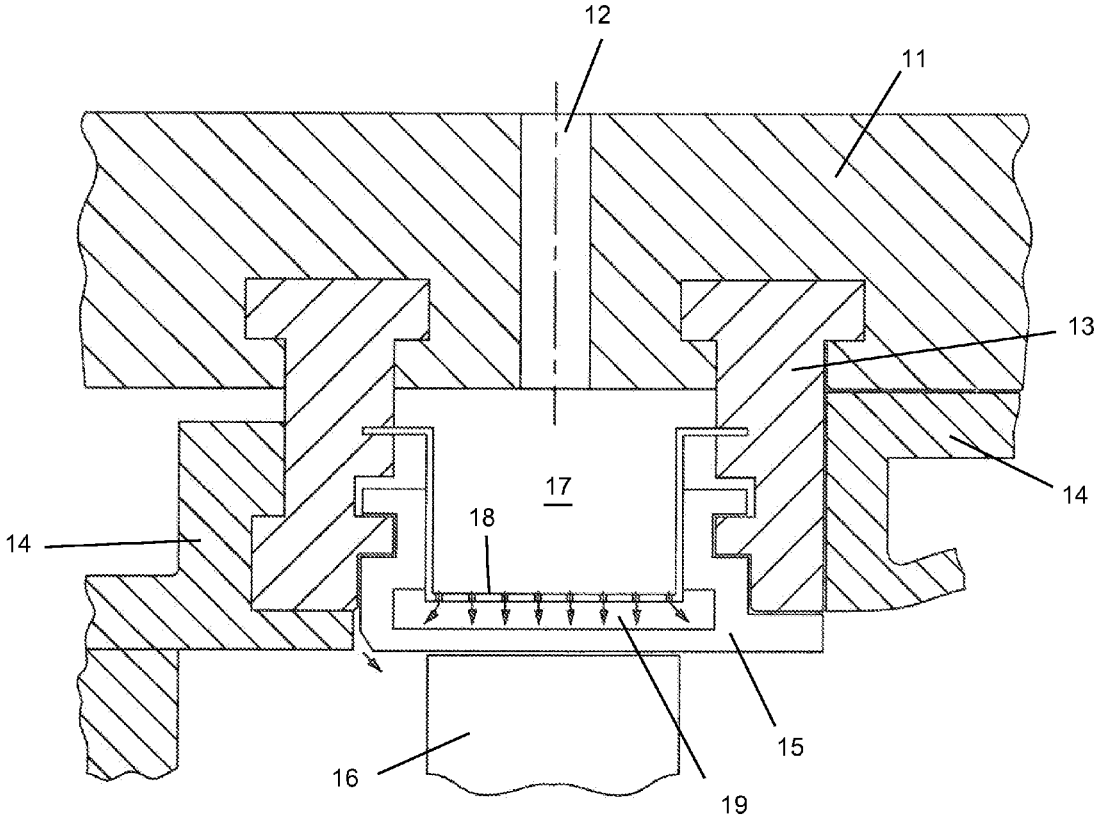
Fig 1 prior art
FIG. 1 shows a cross section view of a prior art turbine ring segment.
Figure 2:
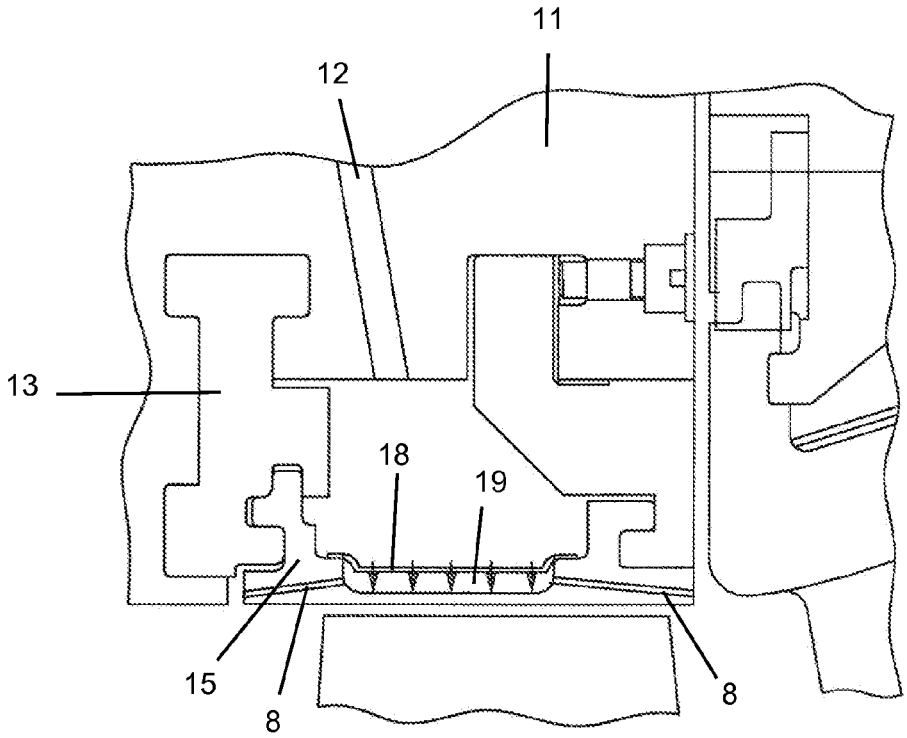
Fig 2 prior art
FIG. 2 shows a cross section view of a prior art turbine ring segment with cooling air holes formed in the ring segment.
Figure 3:
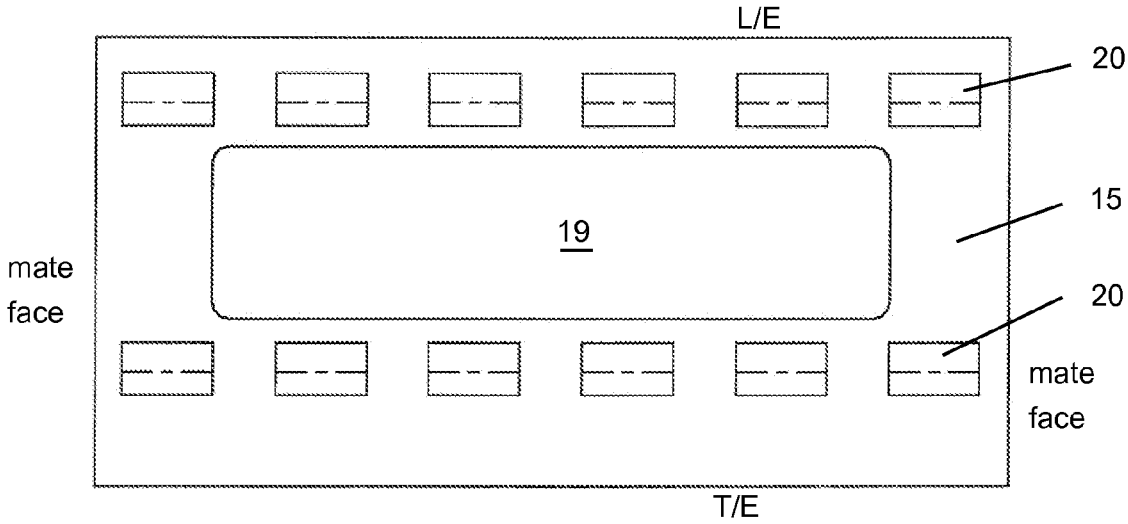
Fig 3 prior art
FIG. 3 shows a top view of the prior art ring segment with hooks and an impingement cavity.
Figure 4:
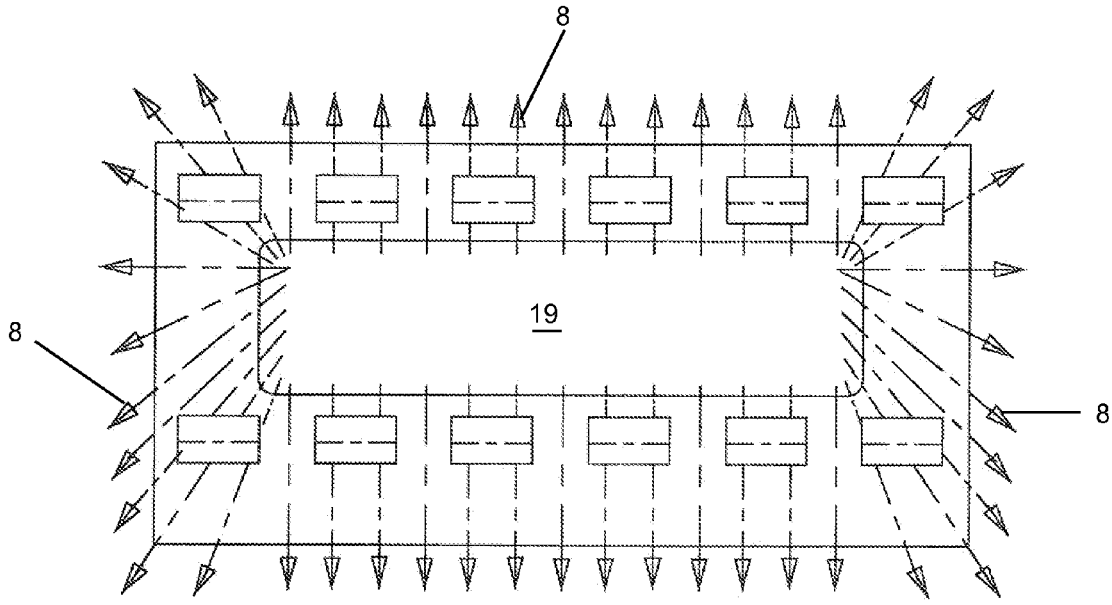
Fig 4 prior art
FIG. 4 shows a top view of the prior art ring segment with the impingement cavity and the cooling holes extending out from the cavity and around all four sides of the ring segment.
Figure 5:
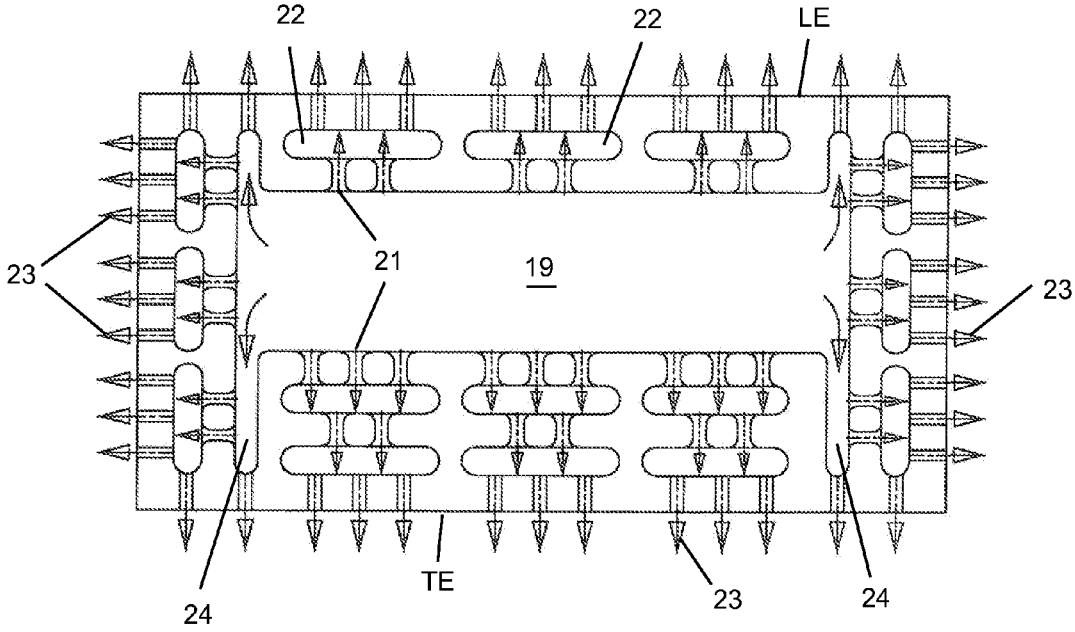
FIG. 5 shows a top view of the ring segment cooling circuit of the present invention.

The ring segment of the present invention includes a cooling circuit that is shown in FIG. 5. The ring segment includes the central impingement cavity 19 in the center for impingement cooling air through the metering and impingement holes in the impingement plate secured over the backside of the ring segment as in the prior art. The ring segment of the present invention includes one or two rows of pressure regulator and impingement chambers 22 spaced along the four edges of the ring segment. Each individual pressure regulator and impingement chamber 22 is connected to the central impingement cavity 19 through a number of metering and impingement holes 21. Also, each individual impingement chamber 22 is then connected to a number of cooling air discharge or exit holes 23 that open onto the four edges of the ring segment. As seen in FIG. 5, the T/E of the ring segment includes two rows of impingement chambers 22 connected in series. The LE and the two mate faces have only one row of impingement chambers 22.

The impingement chambers 22 are spaced around the entire periphery of the four edges of the ring segment in order to cool all of the edges. The metering and impingement holes 21 lead into the impingement chambers 22 and the cooling air discharge holes 23 connect the impingement chamber 22 to the surface of the edges to discharge the cooling air for sealing and cooling purposes. On the two mate face sides of the central impingement cavity 19 are extensions 24 that allow for the cooling air to flow through metering and impingement holes 21 that would be covered by the LE or TE edges.

In operation, cooling air is supplied through the blade ring carrier. The cooling air is then metered through the metering ring and diffused into the compartment cavity. An amount of cooling air for each individual compartment is sized based on the local gas side heat load and pressure in order to regulate the local cooling performance and minimize the leakage flow. The cooling air is then metered through the impingement plate brazed on the backside of the ring segment to impinge onto the backside of the ring segment in the central impingement cavity. The spent cooling air is then metered through the metering and impingement holes and into the pressure regulator impingement chambers positioned along the edges of the ring segment for cooling of the edges. The spent cooling air is impinged onto the backside of the ring segment edges and then discharged from the ring segment into a cavity in-between an upstream and a downstream interface of adjacent ring segments to provide additional film cooling for the adjacent ring segment edges or to function as purge air for a cavity formed between adjacent ring segments.

With the ring segment cooling circuit of the present invention, the usage of cooling air for a given ring segment inlet gas temperature and pressure profile is maximized. In addition, the cooling circuit achieves a total control of the cooling air distribution for the ring segment edge cooling flow as well as multiple impingement cooling. Optimum cooling flow utilization is achieved with this ring segment cooling circuit. In summary, the combination effects of multiple metering and impingement in series with peripheral edge cooling pressure regulation provides for a very effective cooling arrangement and a uniform metal temperature for the ring segment.

I claim the following:

1. A ring segment for a turbine or a gas turbine engine, the ring segment comprising:

a leading edge side and a trailing edge side and two mate faces;

an inner surface forming a hot gas flow path;

an outer surface with a central impingement cavity;

each of the four edges having a plurality of separate impingement chambers formed within the edges;

each of the impingement chambers being connected to the central impingement cavity by a plurality of impingement and metering holes; and, each of the impingement chambers being connected to a plurality of cooling air exit holes that open onto a surface of the edges.

2. The ring segment of claim 1, and further comprising:

the trailing edge of the ring segment includes two rows of impingement chambers connected in series.

3. The ring segment of claim 1, and further comprising:

each impingement chamber is connected to two metering and impingement holes and to three cooling air exit holes.

4. The ring segment of claim 1, and further comprising:

the cooling air exit holes are spaced along each of the four edges of the ring segment from one end of the edge to the opposite end of the edge.

5. A process for cooling a ring segment of a turbine in a gas turbine engine, the ring segment having an impingement plate secured onto a top surface of the ring segment and forming a central impingement cavity on a backside of the ring segment, the process comprising the steps of:

metering cooling air to produce impingement cooling of the backside surface of the ring segment;

collecting the spent impingement cooling air in the central impingement cavity;

metering the collected cooling air and impinging the metered cooling air within impingement chambers spaced around all four edges of the ring segment; and, discharging the spent impingement cooling air out the sides of the four edges of the ring segment.

6. The process for cooling a ring segment of claim 5, and further comprising the step of:

passing the metered and impingement cooling air through a series of impingement chambers formed within the trailing edge of the ring segment.

* * * * *